US011273966B2

(12) United States Patent
Holford

(10) Patent No.: US 11,273,966 B2
(45) Date of Patent: Mar. 15, 2022

(54) TOBACCO PACK WITH LABEL

(71) Applicant: British American Tobacco (Investments) Limited, London (GB)

(72) Inventor: Steven Holford, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 0 days.

(21) Appl. No.: 16/963,579

(22) PCT Filed: Jan. 18, 2019

(86) PCT No.: PCT/GB2019/050135
§ 371 (c)(1),
(2) Date: Jul. 21, 2020

(87) PCT Pub. No.: WO2019/145682
PCT Pub. Date: Aug. 1, 2019

(65) Prior Publication Data

US 2021/0053747 A1 Feb. 25, 2021

(30) Foreign Application Priority Data

Jan. 26, 2018 (GB) ..... 1801342

(51) Int. Cl.
*B65D 75/58* (2006.01)
*B65D 85/10* (2006.01)

(52) U.S. Cl.
CPC ..... *B65D 75/5838* (2013.01); *B65D 85/1045* (2013.01); *B65D 85/1081* (2013.01); *B65D 85/10568* (2020.05)

(58) Field of Classification Search
CPC .... B65D 75/58; B65D 75/5838; B65D 85/10; B65D 85/1045; B65D 85/1056; B65D 85/01568; B65D 85/1081
(Continued)

(56) References Cited

U.S. PATENT DOCUMENTS 5,363,955 A 11/1994 Fleenor
5,478,011 A 12/1995 Pham
(Continued)

FOREIGN PATENT DOCUMENTS

DE 202015106399 U1 1/2017
DE 102015013734 A1 4/2017
(Continued)

OTHER PUBLICATIONS

British Search Report for corresponding application GB1802166.7; Report dated Jun. 26, 2018.
(Continued)

*Primary Examiner* — Bryon P Gehman
(74) *Attorney, Agent, or Firm* — Cantor Colburn LLP

(57) ABSTRACT

A pack comprising: a base, the base containing a group of tobacco industry products wrapped in a barrier layer to form a bundle; a lid mounted to the base for rotation between open and closed positions; a section in the barrier layer to define an extraction opening for the extraction of tobacco industry products when the lid is in an open position; and a label having first and second surfaces on opposite sides of the label. The first surface is formed by a first region of the label attached to the section of the barrier layer and the second surface is formed by a second region of the label attached to the lid. An intermediate portion extends between said first and second regions and is configured to be weaker than each of the first and second regions.

10 Claims, 8 Drawing Sheets

(58) Field of Classification Search
USPC ..... 206/268
See application file for complete search history.

(56) References Cited

U.S. PATENT DOCUMENTS

| | | | |
|---|---|---|---|
| 9,499,331 | B2 | 11/2016 | Seyfferth De Oliveira |
| 9,815,613 | B2 | 11/2017 | Seyfferth De Oliveira |
| 10,633,169 | B2 | 4/2020 | Buse |
| 2014/0374290 | A1 | 12/2014 | Seyfferth De Oliveira |
| 2015/0021219 | A1 | 1/2015 | Seyfferth De Oliveira |
| 2015/0374033 | A1 | 12/2015 | Pilzecker |
| 2015/0375923 | A1 | 12/2015 | Pilzecker |
| 2017/0113865 | A1 | 4/2017 | Swede |
| 2017/0203910 | A1 | 7/2017 | Buse |

FOREIGN PATENT DOCUMENTS

| | | | |
|---|---|---|---|
| DE | 102015016456 | A1 | 6/2017 |
| DE | 102016003737 | A1 | 10/2017 |
| EP | 0647571 | A1 | 4/1995 |
| EP | 3009374 | A1 | 4/2016 |
| GB | 461794 | | 2/1937 |
| JP | 1149151 | A | 2/1999 |
| KR | 1020140022366 | A | 2/2014 |
| WO | 2007093288 | A1 | 8/2007 |
| WO | 2008142540 | A1 | 11/2008 |
| WO | 2012049701 | A2 | 4/2012 |
| WO | 2012095135 | A1 | 7/2012 |
| WO | 2012095372 | A1 | 7/2012 |
| WO | 2016059366 | A1 | 4/2016 |
| WO | 2016083608 | A1 | 6/2016 |
| WO | 2016087819 | A1 | 6/2016 |
| WO | 2016087826 | A1 | 6/2016 |
| WO | 2016120674 | A1 | 8/2016 |
| WO | 2016166692 | A1 | 10/2016 |
| WO | 2017072606 | A1 | 5/2017 |
| WO | 2017072730 | A1 | 5/2017 |
| WO | 2017072731 | A1 | 5/2017 |
| WO | 2017097999 | A1 | 6/2017 |
| WO | 2018002033 | A1 | 1/2018 |

OTHER PUBLICATIONS

International Search Report for corresponding application PCT/GB2019/050155 filed Jan. 21, 2019; dated Mar. 21, 2019.

Written Opinion of the International Searching Authority for corresponding application PCT/GB2019/050155 filed Jan. 21, 2019; dated Mar. 21, 2019.

British Search Report for corresponding application GB1801342.5; Report dated Jul. 17, 2018.

British Search Report for corresponding application GB1801347.4; Report dated Jul. 17, 2018.

International Search Report for corresponding application PCT/GB2019/050135 filed Jan. 18, 2019; dated Apr. 4, 2019.

International Search Report for corresponding application PCT/GB2019/050154 filed Jan. 21, 2019; dated May 16, 2019.

Written Opinion for the International Searching Authority for corresponding application PCT/GB2019/050135 filed Jan. 18, 2019; dated Apr. 4, 2019.

Written Opinion of the International Searching Authority for corresponding application PCT/GB2019/050154 filed Jan. 21, 2019; dated May 16, 2019.

| Third region width (%) | Tensile extension at max load (mm) | Max load (gf) |
|---|---|---|
| 100 | 5.2 | 861 |
| 100 | 4.8 | 778 |
| 100 | 5.1 | 782 |
| 80 | 4.9 | 616 |
| 80 | 4.9 | 677 |
| 80 | 5 | 671 |
| 70 | 5 | 548 |
| 70 | 4.9 | 631 |
| 70 | 5.1 | 553 |
| 60 | 4.8 | 527 |
| 60 | 4.5 | 462 |
| 60 | 4.8 | 744 |
| 50 | 4.7 | 464 |
| 50 | 4.4 | 515 |
| 50 | 4.7 | 462 |

TOBACCO PACK WITH LABEL

TECHNICAL FIELD

The present invention relates to a pack for a tobacco industry product such as smoking articles. In particular, the invention relates to a hinged-lid pack having a base containing a bundle of smoking articles and a lid mounted to the base for rotation between open and closed positions to enable access to the bundle of smoking articles to be obtained.

BACKGROUND

Smoking articles, such as cigarettes, are sold in packs. Known packs often comprise an outer carton made from cardboard which has a base and a hinged lid. The base contains a bundle of smoking articles. The smoking articles are wrapped in a flexible barrier layer having a section to define an extraction opening to facilitate removal of a smoking is article from the pack by a consumer when the lid is open. The opening is closed by a flexible label which extends over, and is attached to, the removable section and to the lid so that the label is peeled back by a consumer simultaneously on opening the lid to reveal the extraction opening. A peripheral region of the label may be coated with a non-permanent re-sealable adhesive where it overlaps the barrier layer around the edge of the opening so that the label can be peeled back and replaced a number of times to re-seal the pack and maintain freshness of the smoking articles remaining in the pack.

SUMMARY

In accordance with embodiments of the invention, there is provided a pack comprising:

- a base, the base containing a group of tobacco industry products wrapped in a barrier layer to form a bundle;
- a lid mounted to the base for rotation between open and closed positions;
- a section in the barrier layer to define an extraction opening for the extraction of tobacco industry products when the lid is in an open position; and
- a label having first and second surfaces on opposite sides of the label, the first surface formed by a first region of the label being attached to the section of the barrier layer and the second surface formed by a second region of the label being attached to the lid, wherein an intermediate portion extends between said first and second regions;
- wherein the label is configured such that the intermediate portion of the label is weaker than the first region.

The intermediate portion may comprise a reduction in the cumulative width relative to the first region, measured perpendicular to a longitudinal axis of the label.

The intermediate region may progressively narrow from the first region to the second region.

A cut out in the label may form a window in the intermediate region.

The intermediate region may comprise recesses extending from edges of the label so that the cumulative width of the intermediate region is less than the cumulative width of the first and second regions.

The cumulative width of the intermediate region of the label may be between 80% and 50%; or between 80% and 60% of the width of the first region of the label.

The cumulative width of the intermediate region of the label may be about 70% of the width of the first region of the label.

The intermediate region of the label may comprise shaped cuts which define a portion of the intermediate region that is free to move independently of the rest of the label, such that, as the lid is rotated towards its open position, said portion of the intermediate region remains in the plane defined by the second region of the label.

The portion of the intermediate region defined by the shaped cuts may be permanently adhered to the lid so that, as the lid is rotated between open and closed positions, said portion of the intermediate region remains in the plane defined by the front wall of the lid.

The label material of the intermediate region may be weakened relative to the first and second regions.

The intermediate portion may comprise lines of weakening that extend across the intermediate portion, between longitudinal edges of the label.

The lines of weakening may comprise score lines and/or embossed fold lines and/or lines of perforations.

Also in accordance with embodiments of the invention, there is provided a label comprising first and second first regions and an intermediate portion extending between said first and second regions, wherein the intermediate portion of the label is weaker than each of the first and second regions.

The intermediate portion may comprise a reduction in the cumulative width relative to the first region, measured perpendicular to a longitudinal axis of the label.

The intermediate region may progressively narrow from the first region to the second region.

A cut out in the label may form a window in the intermediate region.

The intermediate region may comprise recesses extending in from edges of the label so that the cumulative width of the intermediate region is also less than the cumulative width of the second region.

The cumulative width of the intermediate region of the label may be between 80% and 50%; or between 80% and 60% of the width of the first region of the label.

The cumulative width of the intermediate region of the label may be about 70% of the width of the first region of the label.

The intermediate region of the label may comprise shaped cuts which define a flap in the intermediate region.

The label material of the intermediate region may be weakened relative to the first and second regions.

The intermediate portion may comprise lines of weakening that extend across the intermediate portion, between longitudinal edges of the label.

The lines of weakening may comprise score lines and/or embossed fold lines and/or lines of perforations.

Adhesive may be applied to the first and second regions.

The adhesive may be applied to a first surface of the label forming the first region and to a second surface of the label forming the second region, the first and second surfaces being on opposite sides of the label.

Also in accordance with embodiments of the invention, there is provided a method of weakening an intermediate portion of a label extending between first and second regions, comprising subjecting the intermediate portion to a laser cutting and/or scoring process.

BRIEF DESCRIPTION OF THE DRAWINGS

Embodiments of the invention will now be described, by way of example only, with reference to the accompanying drawings, in which.

DETAILED DESCRIPTION

Figure 1:
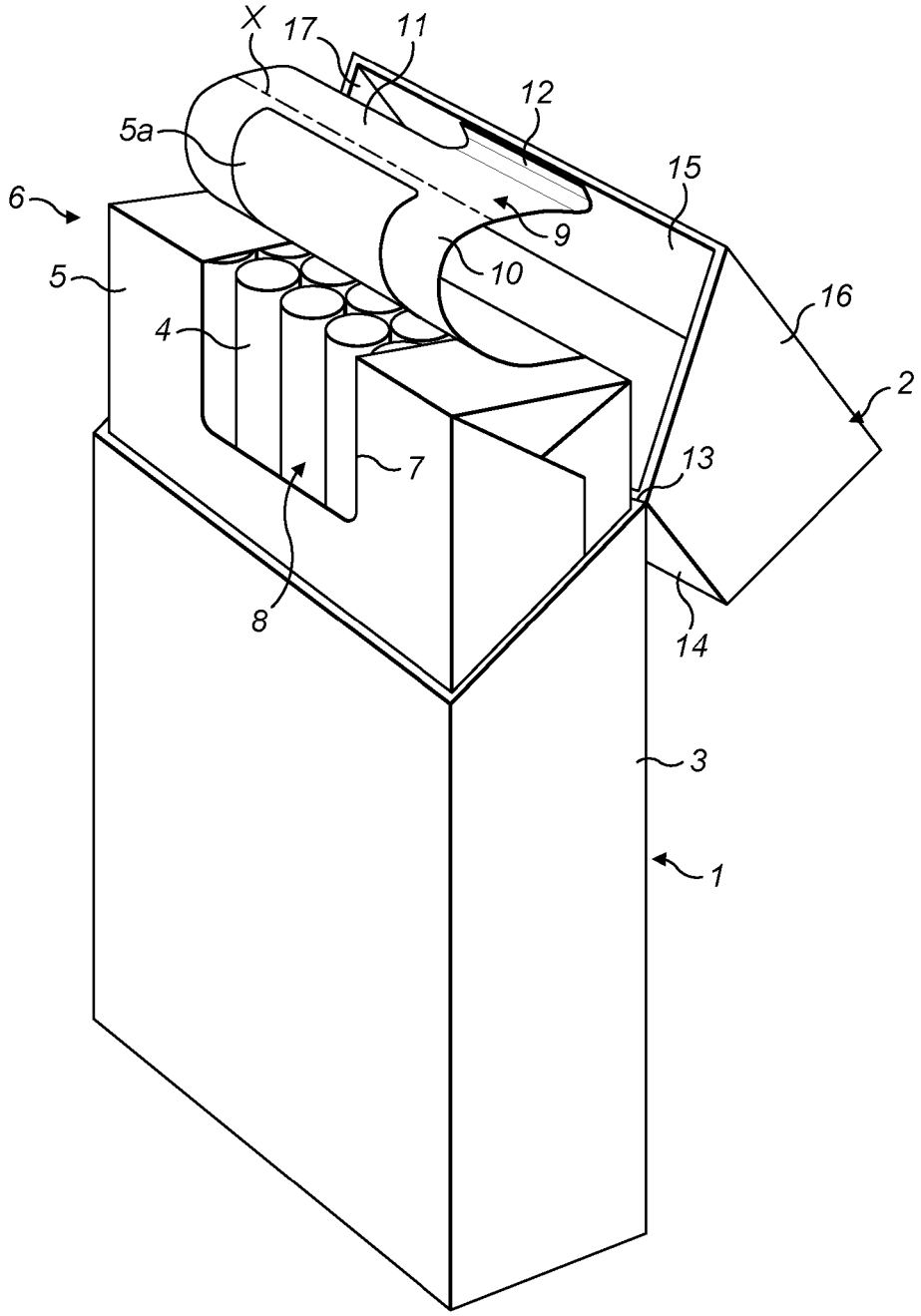
FIG. 1 shows a tobacco industry product pack.

FIG. 1 illustrates a pack according to embodiments of the invention. The pack comprises a rigid card pack 1 with a hinged lid 2 and a base 3 containing a group of cigarettes 4 wrapped in a barrier layer 5 to form a bundle 6 that protrudes from an open end of the base 3 of the pack 1 when the lid 2 is in its open position. The bounds or edges 7 of an extraction opening 8 form a removable flap 5*a*, or section 5*a*, in the barrier layer 5 for allowing access to the cigarettes 4 and extend from the rear side of the barrier layer 5 across the top of the bundle 6 and down the front as far as a lower front wall extraction opening edge 7*a*. The barrier layer 5, which wraps about the cigarettes 4, may be made of metallized plastics or of a plastics/metal foil laminate. A label 9 is provided to lift flap 5*a* as will be explained below.

The label 9 is made of a flexible thin sheet of material and comprises a first region 10 overlying the extraction opening 8 and section 5*a*, prior to a first opening of the pack 1. This is shown most clearly in FIG. 2, in which a lower boundary of the first region 10 is illustrated by a dashed line X which demarks the first region 10 from further regions 11, 12 of the label 9 that will be expanded upon below. The first region 10 of the label 9 overlaps the extraction opening 8 and extends beyond it, so that a peripheral portion of the first region 10 lies beyond the extraction opening 8 for releasable adherence to the bundle 6.

A part of a first surface formed by the first region 10 of the label 9 facing the barrier layer 5, and section 5*a*, is coated with a re-stick adhesive. For the avoidance of doubt, the first surface of the label 9 is the underside of the label, that is, the side of the label 9 facing the barrier material.

Alternatively, a permanent bonding adhesive may be applied to the portion of the underside of the first region 10 of the label 9 that overlaps section 5*a* but does not extend beyond it, with a coating of re-stick adhesive applied to the peripheral portion. In use, the label 9 is peeled progressively from a lower edge 27 away from the bundle 6 to reveal the extraction opening 8 as described below. If re-stick adhesive is used to stick the label to the removable section 5*a*, the strength of that adhesive is selected so that the label will always remain adhered to the removable section 5*a*.

The lid 2 hinges with respect to the base 3 along a lower edge 13 of a rear wall 14 and further comprises a front wall 15 disposed opposite the rear wall 14 and separated by side panels 16, 17. Lower edges of the front wall 15, rear wall 14 and side panels 16, 17 define an opening through which the protruding part of the bundle 6 is received when the lid 2 is in its closed position.

A part of a second surface formed by a second region 12 of the label 9 is permanently adhered to the inside surface of the front wall 15 of the lid 2 so that the label 9 is peeled away from the barrier layer 5 simultaneously with opening of the lid 2. It shall be appreciated that the second surface of the label 9 is the opposite side of the label 9 to the first surface, so that the second surface faces away from the barrier layer 5.

When the lid 2 is pivoted about its hinge into its open position, the label 9 is also pulled due to the connection between the second region 12 of the label 9 and the lid 2. This results in the label 9 being peeled back or rolled away from the extraction opening 8 with the section 5*a* of the barrier layer 5 also being lifted away from the extraction opening 8 together with the label 9, as most clearly illustrated by FIG. 1.

On first opening, the edge 7 of the extraction opening 8 separating section 5*a* from the remainder of the barrier layer 5 may be defined by lines of weakening in the barrier material 5 or by actual cuts so that, when the label 9 is pulled back, the section 5*a* of the barrier layer 5, which remains adhered to the underside of the first region 10 of the label 9, separates from the remainder of the barrier layer 5 along the lines of weakening or cuts to open the extraction opening 8. The consumer is then free to remove cigarettes 4 from the bundle 6 through the extraction opening 8. To reseal or close the extraction opening 8 the consumer moves the lid into its closed position and the label 9 is rolled back over the extraction opening 8 so that the peripheral portion of the label 9 re-adheres to the barrier layer 5 in a region surrounding the periphery of the extraction opening 8. The section 5*a* of barrier layer 5 formed by the separation when label 9 is peeled back is returned to its previous position within the extraction opening 8. Although there is a line of separation in the barrier layer 5, it is covered by the adhered peripheral portion of the label 9.

Figure 2:
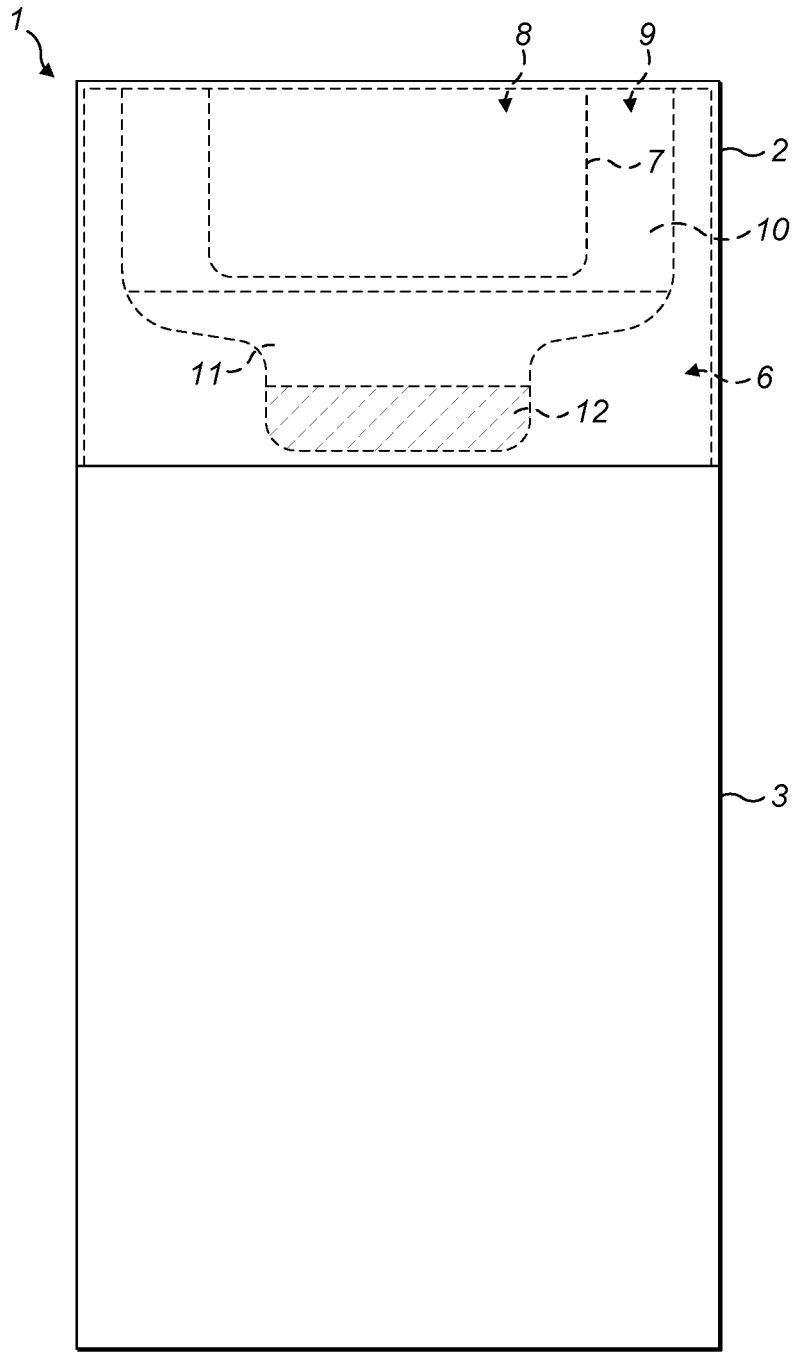
FIG. 2 is a front elevation view of the pack.
Figure 3:
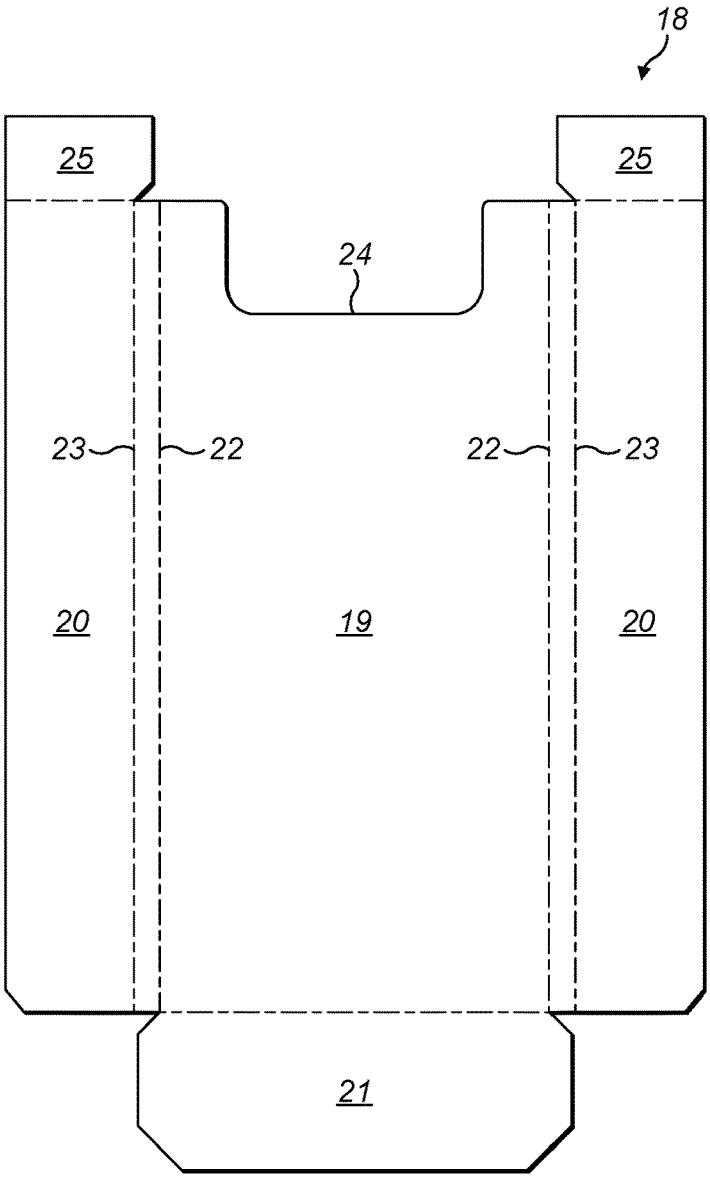
FIG. 3 shows an inner frame for the pack.
Figure 4:
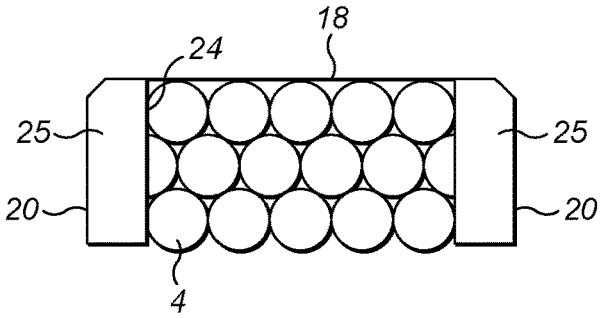
FIG. 4 shows a top view of the inner frame containing a bundle of tobacco industry product 5 is a side elevation view of the pack.

To ensure proper adhesion, an inner frame 18, as shown in FIGS. 3 and 4, is provided within the bundle 6 so that it extends partially around the cigarettes 4 beneath the barrier layer 5. The inner frame 18 provides a reaction surface underneath the barrier layer 5 against the resealing pressure exerted by the label 9 around the periphery of the extraction opening 8 and helps the bundle 6 maintain its shape within the base 3 of the pack following removal of cigarettes 4. As shown in FIG. 2, the inner frame 18, which may be made of card, has a front panel 19, two side flaps 20 and a bottom flap 21. Score or fold lines 22, 23 form corners as seen in FIG. 4 when the side flaps 20 are folded to right angles with the panel 19. Bottom flap 21 is also folded to right angles. Shoulder flaps 25 extend from upper edges of side flaps 20 and are also folded to right angles to partially cover upper ends of the cigarettes and provide additional support under the barrier material 5. It can be seen that when the inner frame 13 has been folded there is an aperture 24 formed, which corresponds to the extraction opening 8, and through which cigarettes 4 are accessible. The aperture 24 extends to a base edge 25 in the front panel 19.

Figure 5:
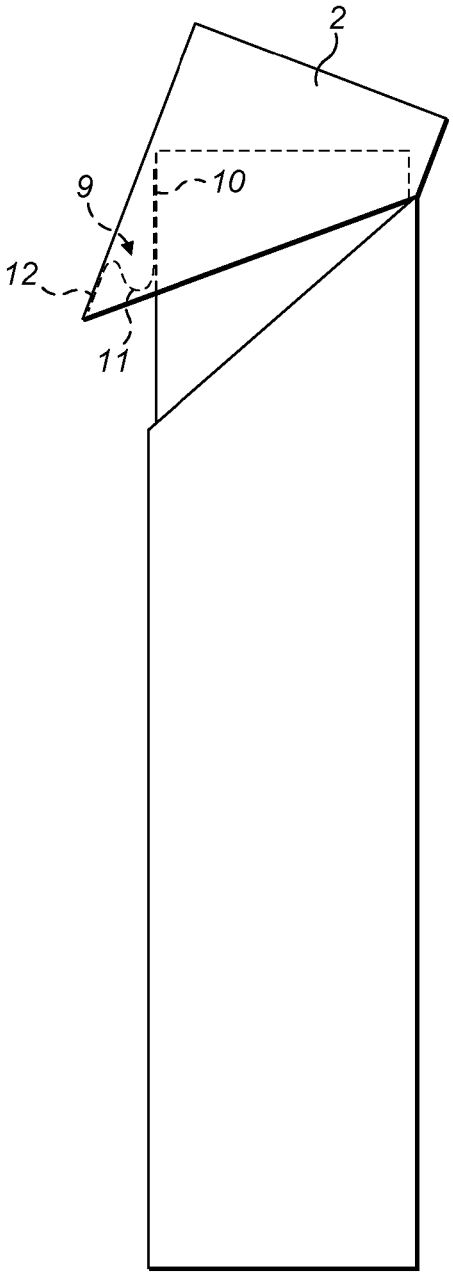

In the present embodiments, because the second surface of the second region 12 of the label 9 is attached to the lid 2, an intermediate portion 11, which extends between first and second regions 10, 12 of the label 9, forms an S shape fold when the lid 2 is in a partially opened state, as show in FIG. 5.

The S shape fold exerts a force on the lid 2 which acts to resist rotation of the lid 2 away from its closed position. This makes the lid 2 quite tricky to open during initial rotation between its closed and partially open state shown in FIG. 5.

It is one advantage of the present invention that the lid 2 is made easier to open by the configuration of the intermediate portion 11 of the label 9, because the force applied to the lid by the intermediate portion which assumes an S-shape on initial opening of the lid is lower as a result of the intermediate portion being weaker, as described in more detail below.

It is one objective of the invention to provide a weakening in the intermediate portion 11 to reduce the force required to form the S shaped fold. Therefore the force required during initial rotation of the lid 2 is reduced making it easier to open.

More specifically, the weakening in the intermediate portion 11 reduces the bending stiffness of the label 9 so that the force applied to the lid by the intermediate portion as a result of the label's bending into an S-shape is reduced. Bending stiffness is defined as proportional to a product of the label's second moment of area and Young's modulus.

It shall be appreciated that, as the force exerted by the label 9 on the inside face of the front wall 15 of the lid 2 is reduced by embodiments of this invention, the permanent adhesive that adheres the label 9 to the inside face of the front wall 15 of the lid 2 is placed under less stress. This confers the further advantage that said permanent adhesive is less likely to fail—causing the label 9 to pull away from the lid—following repeated openings of the pack.

Labels 9 of embodiments of the invention are shown in FIGS. 6A to 6G which are designed for use with the pack described above.

The weakening may be provided by a reduction in the cumulative width of the label 9 in the intermediate portion 11 relative to the first region 10. This has the effect of reducing the amount of label material in the intermediate portion 11 that must be bent into an S shape during initial opening the lid 2. As less material is being bent, less force is required to open the lid 2, partially alleviating the feeling of stickiness during initial opening.

Figure 6C:
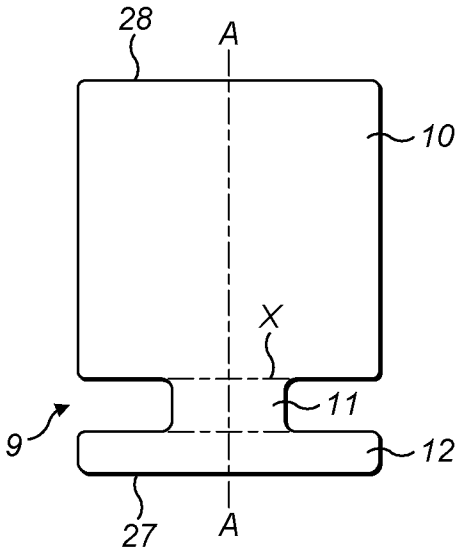
FIG. 6C shows an example label for use with the pack.
Figure 6B:
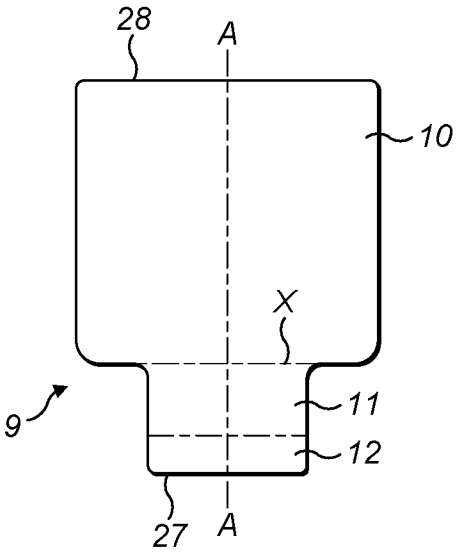
FIG. 6B shows an example label for use with the pack.
Figure 6A:
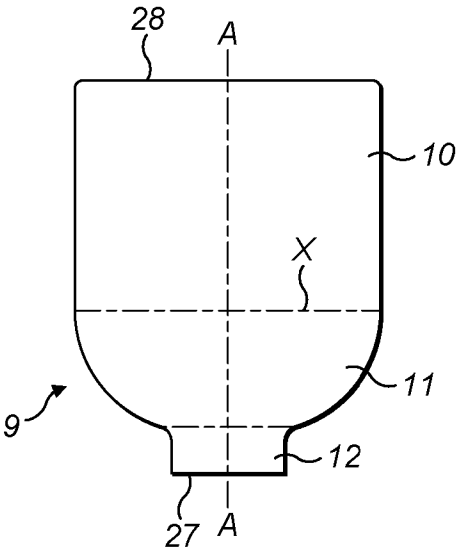
FIG. 6A shows an example label for use with the pack.
Figure 6F:
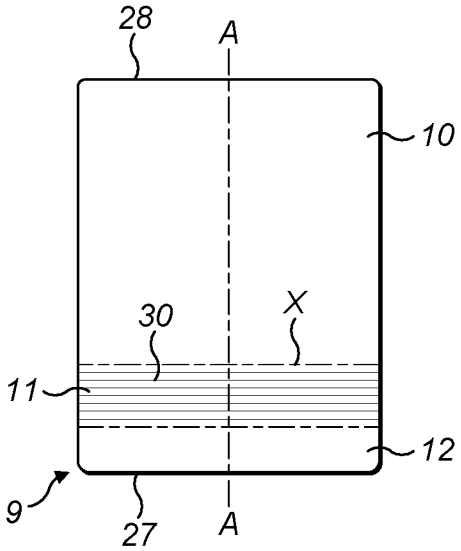
FIG. 6F shows an example label for use with the pack.

In the present embodiments, the cumulative width of the label 9 is measured perpendicular to a longitudinal axis of the label 9, that is, the axis A-A which bisects lower and upper edges 27, 28 of the label 9. FIGS. 6A to 6D show example labels 9 for which the cumulative width of the intermediate portion 11 is reduced relative to the first region 10. As illustrated, the cumulative width of the intermediate portion 11 can be reduced by either reducing the overall width of the intermediate portion 11, as shown in FIGS. 6A to 6C, or by providing a cut out to form one or more windows 26 in the intermediate portion 11, as shown in FIG. 6D, or both. Where a window 26 is provided in the intermediate portion 11, the cumulative width is reduced by the width of the window 26. In this regard, it shall be appreciated that cumulative width is distinct from overall width, which is simply the distance between opposing sides of the label 9. By contrast, cumulative width is the sum of the widths where label material is present.

Where the cumulative width of the intermediate portion 11 of the label 9 is reduced relative to the first region 10 by reducing the overall width of the intermediate portion 11, this may be achieved by stepping in opposing parallel sides of the intermediate portion 11 of the label 9, as shown in FIGS. 6B and 6C, or by gradually tapering the label 9 toward the second region 12 as shown in FIG. 6A. Where opposing sides of the intermediate portion 11 of the label 9 are not parallel, such as the embodiment of FIG. 6A, the cumulative width of the intermediate portion 11 is defined at its narrowest point.

It can also be desirable to have a minimum overall width of the second region 12 to ensure sufficient label area is presented for adhering to the inside face of the lid 2. This is achieved by stepping out opposing sides of label 9 in the second region 12 as shown in FIG. 6C. Put another way, the label 9 can be cut in from opposing parallel sides in the intermediate portion 11 so that the overall width of the second region 12 remains unchanged relative to the first region 10, while the overall width of the intermediate portion 11 is reduced relative to the first and second regions 10, 12.

Although only rectangular windows 26 are illustrated in the embodiment of FIG. 6D, it shall be appreciated that the one or more windows 26 may take any shape that provides the effect of reducing the cumulative width of the label 9 in the intermediate portion 11.

Figure 6E:
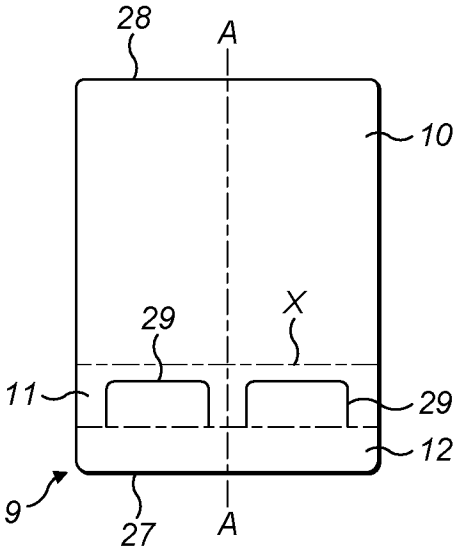
FIG. 6E shows an example label for use with the pack.
Figure 6D:
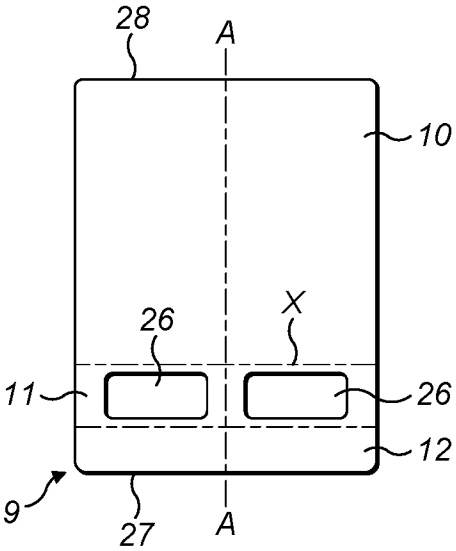
FIG. 6D shows an example label for use with the pack.

In another embodiment shown in FIG. 6E, U shaped cuts 29 are provided in the intermediate portion 11 to define one or more flaps in the label. This is simpler to manufacture than providing complete windows 26 as there is no waste chad material to remove during cutting of the label 9. Instead, the outer surface of the area of the flap defined by the U shaped cuts 29 is also provided with permanent adhesive so that it remains adhered to the inside surface of the front wall 15 of the lid 2 as it is opened. Therefore, the flap defined by the U shaped cuts 29 is not folded into an S shape during initial opening of the lid 2, but remains in the plane defined by the front wall 15 of the lid 2 and therefore parallel to the second region of the label 12. This has the effect of weakening the intermediate portion 11 of the label 9 as, in use, the cumulative width of the intermediate portion 11 is reduced relative to the first region 10 when the lid 2 is opened and the intermediate portion 11 is bent into an S shape.

It shall be appreciated that the flap in the intermediate portion 11 defined by cuts 29 need not be adhered to the inside face of the lid 2 as this is not essential to provide the weakening effect. Instead said flap in the intermediate portion 11 may be free to move independently the rest of the label 9. The weakening effect is still provided as, regardless of whether said flap is adhered to the inside face of the lid 2, said flap does not contribute to the width of the label 9 bent into an S shape during initial opening of the lid 2.

It shall be further appreciated that cuts 29 need not be U shaped. Any shape that demarks a flap, or region, in the intermediate portion 11 for independent movement of the rest of the label 9 will confer the same technical advantage. For example, in another embodiment illustrated by FIG. 6G, the cut 29 forms a sinusoidal shape. This defines a tongue 31 that is demarked by a trough 31 between two crests of the sinusoidal cut 29. Advantageously, the tongue 31 is not adhered to the lid 2, but instead flicks against the inside surface of the front wall 15 of the lid 2 as it is closed to give an audible click. Such audible clicks are generally considered by consumers to signify a mark of quality.

In another embodiment, the weakening may be provided by lines of weakening 30 that extend across the intermediate portion 11, perpendicular to the longitudinal axis of the label 9. For example, in another embodiment shown in FIG. 6F, score lines 30 are provided extending across the intermediate portion 11 to reduce the region's resistance to bending. Therefore the force required to form the S shape is reduced during initial opening of the pack. The lines of weakening 30 are not limited to score lines but may be, for example, embossed fold lines or lines of perforations etc.

In the embodiments described above with reference to FIGS. 6A to 6E and 6G, the method of weakening the intermediate portion 11 of the label 9 preferably comprises using a laser cutter to shape the label 9, such as to reduce the cumulative width of the intermediate portion 11, or to cut windows 26 or slits 29 into the intermediate portion 11. In the embodiment described with reference to FIG. 6F, the method may comprise using a laser scorer to score the intermediate portion to provide the lines of weakening 30.

In the above described embodiments of the invention, the label material itself may be weakened in the intermediate portion 11 so that the material is inherently less resistant to bending. For example, labels of the type described above may be constructed from a laminate having layers of, for example, oriented polypropylene. It is envisaged that a layer of the laminate may be omitted from the intermediate portion 11 to reduce the local stiffness relative the first and second regions 10, 12 of the label.

In the above described embodiments, the lid 2 may further comprise a tuck in flap (not shown). Such flaps are conventional in the field of cigarette packs and represent an additional panel that extends from a lower edge of the front wall 15 lid 2 that is folded back against the inside face of the front wall and adhered thereto. The second region 12 of the label 9 is then adhered to the tuck in flap.

Packs are normally formed from paper card, but in some cases card having a metallised finish on one surface is used to give a shiny attractive appearance. It has been found that labels 9 like those described above do not adhere well to the shiny side of metallised card. In such cases it is desirable to provide an additional panel that extends from the tuck in flap and is folded back again so that the tuck in flap and the additional panel concertina against the inside surface of the front wall 15 of the lid 2. It is envisaged that labels 9 of the above described embodiments may also be used with such packs, wherein the provision of the additional panel presents a non-metallised surface for better adherence to the second region 12 of the label 9. The additional panel and the tuck in flap may be adhered together or may be free to hinge with respect to the front wall 15 of the lid 2 as desired.

Figures 6G, 7:
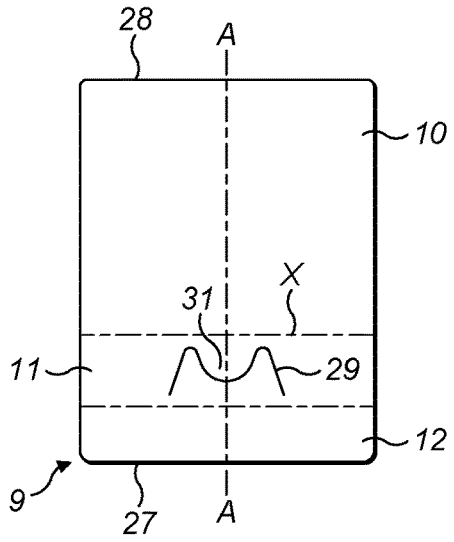
FIG. 6G shows an example label for use with the pack.
FIG. 7 is a table of test data taken during testing of the pack.

FIG. 7 is a table of test results showing the effect of a reduction in the cumulative width of the label 9 in the intermediate portion 11 relative to the first region 10, expressed as a percentage of the width of the first region 10, on the force required to open the lid 2. Three force readings were taken for each cumulative width value. Each force reading represents the peak force in grams required to open the lid 2.

To carry out the test a sample pack 1 was oriented so that it stands on a bottom face of the base 3 and secured in place. A hook was placed under the lower edge of the front wall 15 of the lid 3 and retracted vertically upwards to cause the lid 2 to rotate into the is open position. The force exerted by the hook was recorded with displacement: The peak force and the displacement at which peak force occurred were recorded. Referring to FIG. 7, peak force corresponds with the values in the column headed 'Max Load (gf)', while the displacement at which peak force occurred corresponds with the values in the column headed 'Tensile extension at max load (mm)'. The table illustrates that the peak force is reliably recorded at around 5 mm of displacement of the lid 2 which equates to the movement of the lid 2 during initial opening.

Figure 8:
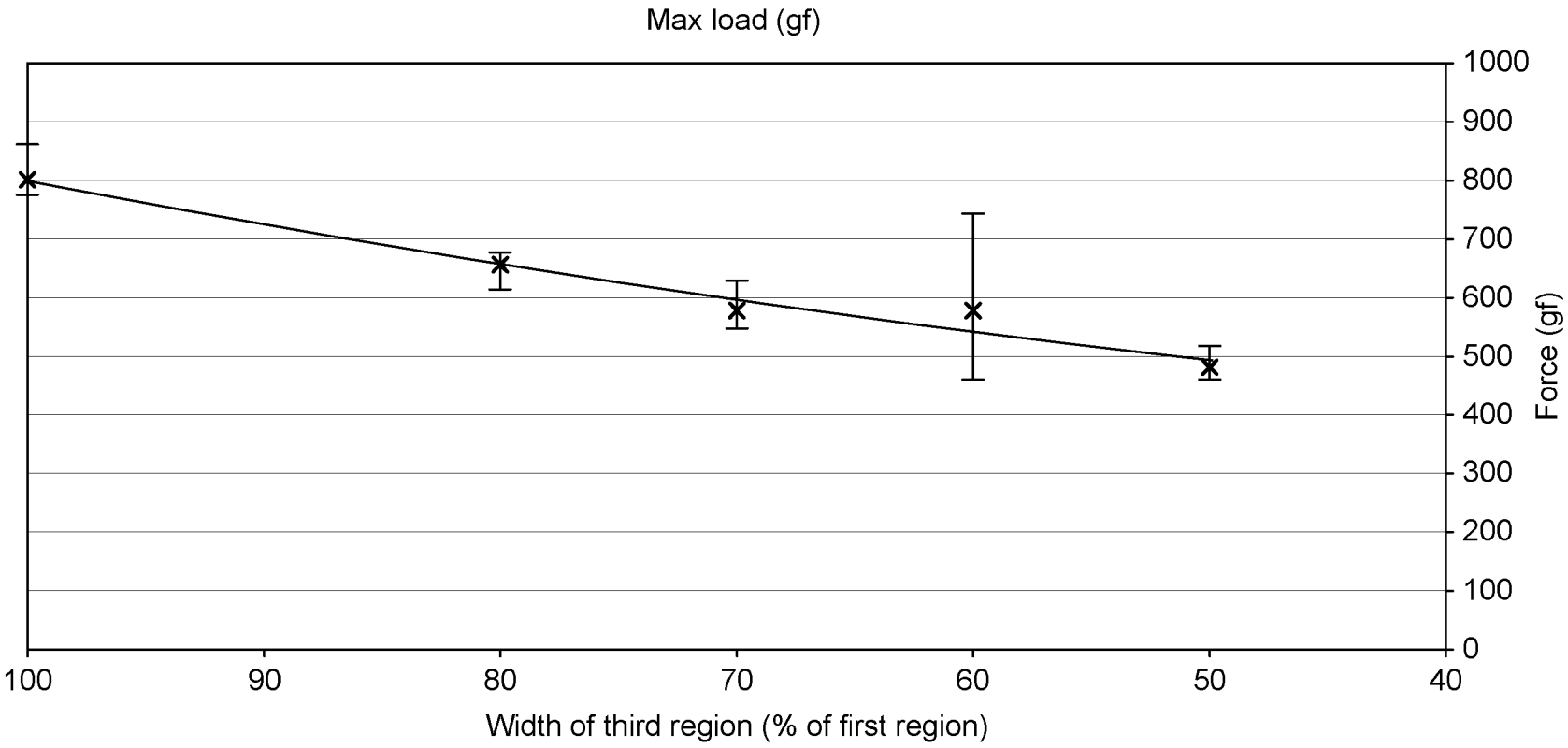
FIG. 8 is a chart graphically illustrating the test data.

FIG. 8 is a scatter chart of the data of FIG. 7. The three readings taken for each percentage width data set have been averaged and plotted with maximum and minimum values of force for each data set shown as error bars. A second order polynomial line of best fit has been added to graphically represent the trend.

The test results demonstrate that a reduction in the cumulative width of the intermediate portion 11 relative to the first region 10 results in a reduction in the peak force required opening the pack. In a preferred embodiment, the width of the intermediate portion 11 of the label 9 expressed as a percentage of the width of the first region 10 is between 80% and 50%; or, more preferably, between 80% and 60%; or, yet more preferably around 70%. However, embodiments in which the label is between 50% and 60% or between 50% and 70% are not excluded. The selection of the width of the intermediate portion 11 relative to the first region 10 will depend on the particular opening characteristics required.

The width of the first region of the label of the above described embodiments may be between 50 mm and 30 mm; or, more preferably, between 45 mm and 35 mm; or, yet more preferably, between 45 mm and 40 mm. In a particularly preferred embodiment, the width of the first region of the label is 42 mm wide. Said widths are overall widths measured between opposing longitudinal edges of the first region 10 of the label 9 at its widest point.

It shall be appreciated that the width of the first region 10 is largely necessitated by the requirement to cover the extraction opening which must be wide enough to allow a user to extract cigarettes 4.

As used herein, the term "tobacco industry product" is to be understood as including smoking articles comprising combustible smoking articles such as cigarettes, cigarillos, cigars, tobacco for pipes or for roll-your-own cigarettes, (whether based on tobacco, tobacco derivatives, expanded tobacco, reconstituted tobacco, tobacco substitutes or other smokable material), electronic smoking articles such as e-cigarettes, heating devices that release compounds from substrate materials without burning such as tobacco heating products; and hybrid systems to generate aerosol from a combination of substrate materials, for example hybrid systems containing a liquid or gel or solid substrate.

In one embodiment, the tobacco industry product is a smoking article for combustion selected from the group consisting of a cigarette, a cigarillo and a cigar.

In one embodiment, the tobacco industry product is a non-combustible smoking article.

In one embodiment the tobacco industry product is a heating device which releases compounds by heating, but not burning, a substrate material. The material may be for example tobacco or other non-tobacco products, which may or may not contain nicotine. In one embodiment the heating device is a tobacco heating device.

In another embodiment the tobacco industry product is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment the hybrid system comprises a liquid or gel substrate and tobacco.

Embodiments of the invention are described with reference to tobacco industry products, for example cigarettes. However, it will be appreciated that packages of the invention may alternatively be used for non-tobacco industry related products.

In order to address various issues and advance the art, the entirety of this disclosure shows by way of illustration various embodiments in which the claimed invention(s) may be practiced and provide a superior package for tobacco industry products. The advantages and features of the disclosure are of a representative sample of embodiments only, and are not exhaustive and/or exclusive. They are presented only to is assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A pack comprising:

a base, the base containing a group of tobacco industry products wrapped in a barrier layer to form a bundle;

a lid mounted to the base for rotation between an open position and a closed positions;

a section in the barrier layer to define an extraction opening for the extraction of tobacco industry products when the lid is in the open position; and a label having a first surface and a second surfaces on opposite sides of the label, the first surface formed by a first region of the label that overlaps and is attached to the section of the barrier layer defining the extraction opening, the second surface formed by a second region of the label being attached to the lid, wherein an intermediate portion extends between said first and second regions;

wherein the label is configured such that the intermediate portion of the label is weaker than the first region.

2. A pack according to claim 1, wherein the intermediate portion comprises a reduction in the cumulative width relative to the first region, measured perpendicular to a longitudinal axis of the label.

3. A pack according to claim 2, wherein the intermediate portion progressively narrows from the first region to the second region.

4. A pack according to claim 2, wherein a cut out in the label forms a window in the intermediate region.

5. A pack according to claim 2, wherein the intermediate region comprises recesses extending from edges of the label so that the cumulative width of the intermediate region is less than the cumulative width of the first and second regions.

6. A pack according to claim 2, wherein the cumulative width of the intermediate portion of the label is between 80% and 50%; or between 80% and 60% of the width of the first region of the label.

7. A pack according to claim 1, wherein the intermediate region of the label comprises shaped cuts which define a portion of the intermediate region that is free to move independently of the rest of the label, such that, as the lid is rotated towards its open position, said portion of the intermediate region remains in the plane defined by the second region of the label.

8. A pack according to claim 7, wherein the portion of the intermediate region defined by the shaped cuts is permanently adhered to the lid so that, as the lid is rotated between open and closed positions, said portion of the intermediate region remains in the plane defined by the front wall of the lid.

9. A pack according to claim 1, wherein the label material of the intermediate region is weakened relative to the first and second regions.

10. A pack according to claim 9, wherein the intermediate portion comprises lines of weakening that extend across the intermediate portion, between longitudinal edges of the label.

* * * * *